US012687362B1

(12) United States Patent
Watts

(10) Patent No.: US 12,687,362 B1
(45) Date of Patent: Jul. 21, 2026

(54) MULTIDIRECTIONAL TRIGGER MECHANISM

(71) Applicant: Eighty-O-Eight Products, LLC, Spokane, WA (US)

(72) Inventor: Randy Tyler Watts, Spokane, WA (US)

(73) Assignee: Eighty-O-Eight Products, LLC, Spokane, WA (US)

( * ) Notice: Subject to any disclaimer, the term of this patent is extended or adjusted under 35 U.S.C. 154(b) by 0 days.

(21) Appl. No.: 19/249,838

(22) Filed: Jun. 25, 2025

(51) Int. Cl.
*F41A 19/10* (2006.01)

(52) U.S. Cl.
CPC ..... *F41A 19/10* (2013.01)

(58) Field of Classification Search
CPC ..... F41A 19/10
USPC ..... 42/69.01
See application file for complete search history.

(56) References Cited

U.S. PATENT DOCUMENTS

2018/0224232 A1* 8/2018 Gillette ..... F41A 19/10
2019/0353443 A1* 11/2019 Gillette ..... F41A 19/12

FOREIGN PATENT DOCUMENTS

WO WO-2024018669 A1 * 1/2024 ..... F41A 19/10

* cited by examiner

*Primary Examiner* — Samir Abdosh
(74) *Attorney, Agent, or Firm* — IRON SUMMIT IP LLP

(57) ABSTRACT

A trigger mechanism that, in various examples, may be configured to pivot or rotate in multiple directions, enabling actuation along multiple axes or planes of motion consistent with natural finger movement. For instance, a trigger may be supported or otherwise connected to a host device—such as a firearm, tool, or other manually actuated mechanism—in a manner that permits movement in multiple directions or rotation about multiple axes, allowing the trigger pull to follow the natural motion path of a user's finger. In some examples, the trigger mechanism may actuate when the trigger reaches one or more defined actuation points or when a threshold level of force is applied—regardless of the trigger's motion path. In this way, the trigger mechanisms of the present disclosure may accommodate the unique trigger pull motions of different users, regardless of hand position, technique, or training level.

20 Claims, 6 Drawing Sheets

MULTIDIRECTIONAL TRIGGER MECHANISM

BACKGROUND

Conventional trigger mechanisms, such as those used in firearms, are typically designed for linear actuation such that the trigger pivots or slides along a single axis, generally aligned in a fore-and-aft direction. In most configurations, the trigger rotates about a fixed horizontal axis, producing movement confined to a single vertical plane. This results in a unidirectional actuation path that limits the trigger's travel to a forward-and-rearward arc relative to the trigger housing. These mechanisms are widely employed across a range of platforms and are considered effective for basic operation and safety compliance. In most instances, the trigger is either directly linked to a mechanical sear or connected via intermediate components that respond to a linear pulling force. This traditional configuration has been refined over time for manufacturability, durability, and standardization across various device models.

However, because conventional trigger mechanisms actuate linearly, they do not account for the natural biomechanics of the human finger, which follows an arched or multidirectional motion path when engaging a trigger. This decoupling between trigger design and anatomical movement often leads to user discomfort, inconsistent finger placement, and the introduction of lateral forces during actuation. These factors can cause deviation in alignment and reduce overall control or accuracy, particularly in precision-dependent or rapid actuation scenarios. Additionally, slight variations in finger depth within the trigger guard can result in unintended lateral input.

SUMMARY

Embodiments of the present disclosure relate to a multidirectional trigger mechanism. More specifically, trigger mechanisms are disclosed that may pivot or rotate in multiple directions, enabling actuation along multiple axes of motion consistent with natural finger movement.

For instance, a trigger may be supported or otherwise connected to a host device-such as a firearm, tool, or other manually actuated mechanism—in a manner that permits the trigger to move in multiple directions and/or about multiple axes (e.g., rotate, pivot, or articulate within a constrained range of motion). In some examples, the trigger may be connected to the host device via one or more articulated connections, compound pivots, or other flexible mounting arrangements that enable multidirectional trigger movement. In some examples, the trigger mechanism may be configured to actuate when a position of the trigger reaches one or more defined actuation points and/or when a threshold level of force is applied-regardless of the trigger's motion path.

In contrast to conventional systems, the trigger mechanisms of the present disclosure may provide improved ergonomic conformity by allowing the trigger to follow a user's natural finger motion, rather than forcing the finger to adapt to a fixed actuation path. This approach may reduce user fatigue and discomfort, particularly during extended or repeated use. The trigger mechanisms of the present disclosure may also minimize the introduction of unintended lateral forces caused by misaligned or inconsistent finger placement, thereby enhancing shot stability, precision, and overall control. Because the trigger mechanisms disclosed herein may be responsive to motion from multiple directions or angles, the trigger mechanisms may accommodate a wider range of hand sizes, finger positions, and user techniques—including those of novice users with limited training. Additionally, the flexibility of the trigger's motion may further support intuitive and adaptive use across various operational contexts. In some instances, these advantages may be achieved without requiring significant modification to the host device's overall form factor or internal firing system.

BRIEF DESCRIPTION OF THE DRAWINGS

The embodiments of the present disclosure relating to a multidirectional trigger mechanism are described in detail below with reference to the attached drawing figures, wherein.

DETAILED DESCRIPTION

Figure 1:
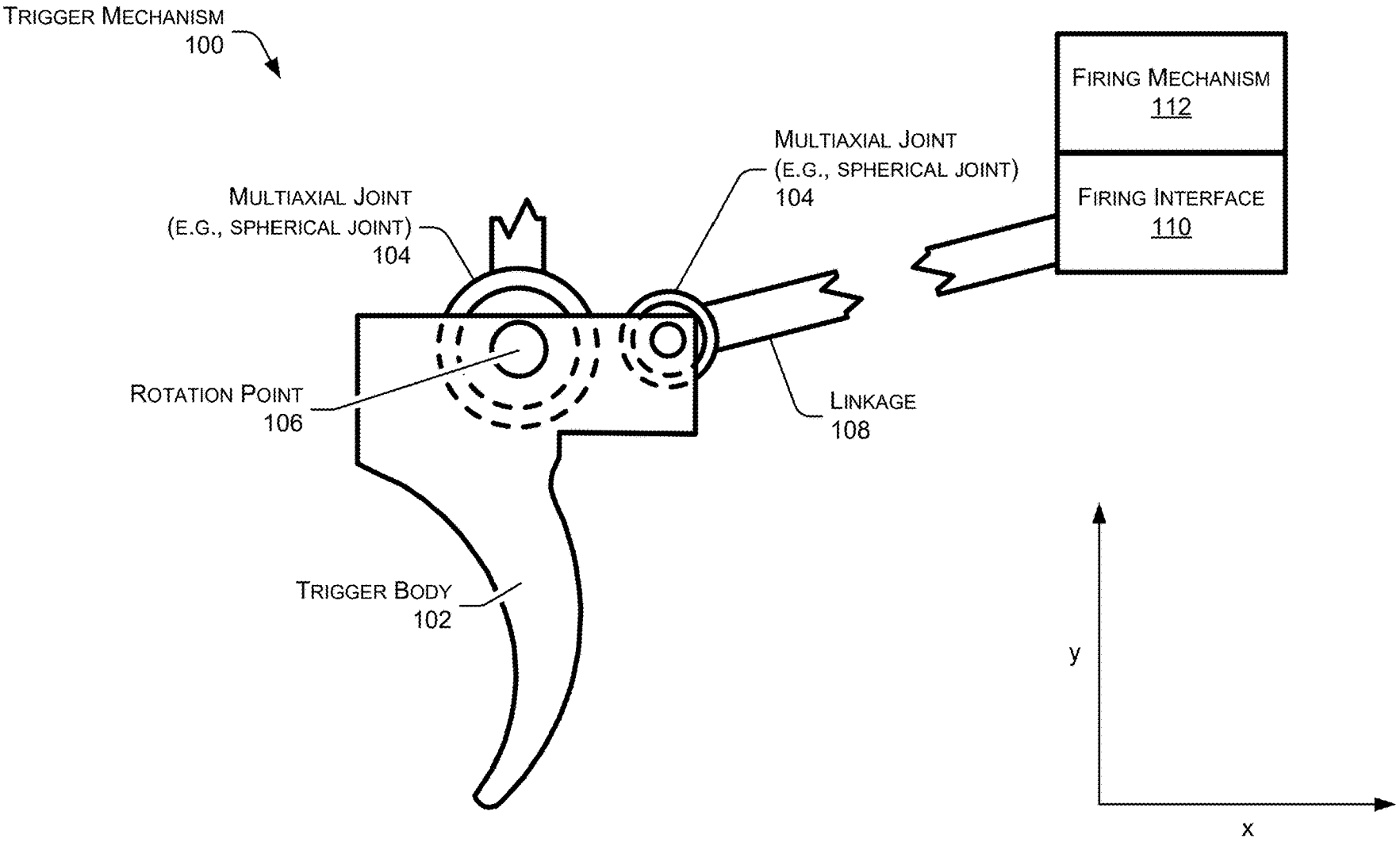
FIG. 1 illustrates a side view of an example multidirectional trigger mechanism, in accordance with some embodiments of the present disclosure.

This application relates to a multidirectional trigger mechanism. For instance, in some examples, a trigger mechanism may include a trigger body, which may be operatively connected to a host device (e.g., firearm, power tool, etc.) via one or more multiaxial joints. The trigger body may be configured to move within a defined three-dimensional range of motion, enabling actuation of the host device along multiple axes, rather than a fixed linear or curved path. In various examples, the multidirectional motion may include rotation, pivoting, or articulation about horizontal, vertical, and/or oblique axes, thereby allowing the trigger pull path to conform more closely to the natural arched movement of an individual user's index finger during trigger engagement.

By way of example, and not limitation, the trigger body (or simply "trigger," as used herein) may comprise an elongated member configured to be engaged by a user's finger for manual actuation of the host device. The trigger body may have a contoured front surface shaped to accommodate the curvature of a human fingertip and may include a generally convex or compound-curved profile to support stable finger placement across a range of engagement angles. In some instances, the trigger body may include textured, serrated, or otherwise tactile surface features to enhance grip and tactile feedback during actuation. The geometry of the trigger body may be symmetric or asymmetric in cross-section, and may be designed to taper, flare, or bulge at specific regions to promote ergonomic engagement and prevent slippage.

The trigger body may be fabricated from durable materials such as high-strength polymer composites, machined aluminum alloys, stainless steel, or reinforced thermoplastics, depending on the desired balance of weight, rigidity, and environmental resilience. In some examples, the trigger body may include integrated or removable inserts to permit user customization of size, surface texture, or trigger reach. The rear surface of the trigger body may include mounting structures, bosses, or interface arms configured to couple the trigger to one or more multiaxial joints, described in more detail below. In some cases, the trigger body may house embedded sensors, return biasing elements, or mechanical stops configured to influence actuation characteristics.

The overall size and shape of the trigger body may be selected to allow unobstructed travel within a trigger guard or housing cavity while accommodating angular displacement in multiple directions. In certain configurations, the trigger body may include over-travel or pre-travel control features such as adjustable set screws or damping elements. In various examples, the mass, center of gravity, and mechanical leverage of the trigger body may be engineered to provide a predictable and repeatable force-displacement response, thereby enhancing control and consistency across variable actuation paths.

In some examples, the multiaxial joint may comprise a mechanical interface that enables the trigger body to move angularly and/or translationally along or about two or more axes. The multiaxial joint may define a pivot point or rotational center and may include one or more joint components configured to accommodate movement in horizontal, vertical, and oblique directions relative to a fixed mounting frame or housing. In various examples, suitable configurations for the multiaxial joint may include, but are not limited to, spherical joints (e.g., ball-and-socket assemblies), compound pivots, double-axis hinges, gimbal mounts, or flexible couplings. In some instances, the joint may provide full or partial spherical articulation, allowing the trigger to deflect or rotate within a conical or dome-shaped envelope of motion.

The multiaxial joint may, in some examples, be positioned at or near an upper portion of the trigger body and may be housed within a joint cavity or retention socket defined by a trigger bracket, housing frame, or intermediate support structure. In various instances, the joint may be constructed from wear-resistant materials such as steel alloys, ceramics, or engineered polymers, and may include low-friction coatings or bushings to facilitate smooth and consistent motion. In some examples, the multiaxial joint may be preloaded with one or more biasing elements (e.g., springs, elastomeric dampers, or torsional rods) configured to urge the trigger body toward a defined neutral or rest position following actuation.

In some instances, to constrain motion and maintain alignment, the multiaxial joint may further include limit stops, detents, or mechanical boundaries that define the extent of allowable angular displacement. These constraints may serve to prevent over-rotation and ensure that the trigger remains within a safe and ergonomic range during operation. Additionally, in some embodiments, the joint may be adjustable, allowing the user or technician to modify the permissible range of motion, stiffness, or return characteristics of the trigger system. In some examples, damping or resistance elements may be integrated within or adjacent to the joint to modify the tactile response or to control the dynamic behavior of the trigger during rapid or multi-axis actuation.

In some examples, the trigger mechanism may include a linkage operatively coupling the trigger body to a firing interface or actuation system of the host device. The linkage may be configured to translate the multidirectional movement of the trigger body-whether rotational, angular, or translational-into a corresponding actuation input suitable for initiating a firing sequence. In some instances, the linkage may include a mechanical arm, rod, cable, or articulated member extending from the rearward portion of the trigger body to a downstream actuation point. The linkage may be rigid or flexible, and may incorporate one or more joints, pivots, or compliant segments to accommodate the variable angles and paths associated with the trigger's multidirectional motion.

In some examples, the linkage may be connected to a mounting surface or bracket positioned adjacent to the multiaxial joint, such that movement of the trigger body about its pivot point produces a corresponding displacement of the linkage. In certain configurations, the linkage may engage with the trigger body via a yoke, clevis, or ball-end connector that permits relative movement without binding or misalignment. In some instances, the linkage may include telescoping or hinged segments that maintain engagement across a range of angular positions. The connection between the linkage and trigger body may be fixed, floating, or adjustable depending on the desired sensitivity, responsiveness, or mechanical amplification of the trigger system.

In various examples, the linkage may terminate at a firing interface—such as a sear, striker actuator, valve, or electronic switch—that may be triggered upon reaching a predefined displacement, force threshold, or angular orientation. In some cases, the linkage may further include biasing components, preload mechanisms, or damping features configured to fine-tune the timing and responsiveness of the firing event. The use of a linkage decoupled from a single linear motion path enables consistent actuation regardless of the trajectory taken by the trigger body, thereby supporting the ergonomic and performance benefits of the multidirectional system.

In some examples, the linkage may interface with a firing interface configured to initiate a functional response within the host device, such as the discharge of a firearm or activation of a mechanical or electrical system. The firing interface may include one or more mechanical elements—such as a sear, striker release, hammer catch, or trigger bar—that respond to movement of the linkage beyond a predefined displacement or pressure threshold. In some instances, the firing interface may be integrated into the existing architecture of a firearm or other device, thereby enabling compatibility with conventional firing assemblies while benefiting from the ergonomic advantages of the multidirectional trigger mechanism.

In certain configurations, the firing interface may be configured to actuate upon reaching a defined actuation point, regardless of the motion path taken by the trigger body to reach that point. For example, whether the user engages the trigger along a primarily vertical, horizontal, or oblique trajectory, the firing interface may be designed to respond uniformly to input from the linkage once the cumulative displacement or force meets a specified threshold. This decoupling of actuation logic from directional input enables a high degree of flexibility in trigger engagement, which may be particularly beneficial in dynamic or high-stress use scenarios.

In some instances, the firing interface may include mechanical stops, detents, or resistance thresholds that provide tactile or audible feedback to the user when the actuation point is approached or reached. In other examples, electronic or sensor-based firing systems may be employed, wherein movement of the trigger body or linkage is detected via a position sensor, strain gauge, or pressure transducer, and converted into a control signal for initiating a firing or operational event. The firing interface may be modular or integrated, and may be designed to accommodate a wide range of host platforms and trigger configurations without substantial modification.

In some examples, the trigger mechanism may be configured such that actuation of the firing interface occurs when the trigger body reaches a defined actuation threshold. This threshold may be based on one or more measurable conditions, including a minimum displacement distance, a defined angular orientation, or a threshold level of applied pressure. In some instances, the threshold may be dynamically adjustable to suit different operational preferences or to comply with safety or performance standards. For example, a threaded adjustment screw, interchangeable detent module, or variable-tension spring may be used to alter the required travel or resistance associated with trigger actuation.

In various examples, the system may incorporate a return mechanism to bias the trigger body toward a neutral or rest position following actuation. The return mechanism may include one or more torsion springs, coil springs, elastomeric members, or magnetic elements operatively connected to the trigger body, the multiaxial joint, or the surrounding frame. In some instances, the return force may be non-uniform across the available motion envelope-such that resistance increases near the limits of travel-thereby providing a centering effect and supporting intuitive repositioning of the trigger between uses.

Additionally, in some configurations, the actuation threshold may be independent of the direction from which the trigger is engaged. That is, the system may be calibrated such that trigger movement from any vector (e.g., upward, rearward, lateral, or oblique) can result in successful actuation, provided that the cumulative displacement or applied force meets or exceeds the threshold. This directional agnosticism enhances operational consistency and may be particularly beneficial in applications involving rapid or reflexive trigger pulls. In some examples, the actuation threshold may be supplemented by visual or tactile indicators—such as resistance ramps, click points, or travel limits—that assist the user in anticipating the firing event.

In some examples, the multidirectional trigger mechanism may further include one or more integrated safety features configured to prevent accidental or unintended actuation. These safety features may include mechanical locks, engagement selectors, or passive restraint systems that inhibit trigger movement unless specific preconditions are satisfied. In some instances, a blocking element may physically obstruct the trigger body or linkage from moving until manually disengaged, while in other examples, a trigger safety tab or detent may require deliberate finger placement to permit motion. These safety features may be particularly useful in law enforcement, military, or high-vibration environments where inadvertent trigger engagement could present significant risks.

In various embodiments, the geometry and configuration of the multidirectional trigger mechanism may be adapted to suit different types, models, or manufacturers of firearms and other host devices. Because internal firing systems vary widely across platforms—including differences in sear designs, striker or hammer configurations, linkage geometries, and housing dimensions—the specific form, materials, and mounting strategy of the trigger mechanism may be tailored on a case-by-case basis. In some instances, modular components or adjustable mounting hardware may be employed to simplify integration across multiple platforms without requiring complete redesign.

Despite these platform-specific variations, the fundamental purpose and operation of the trigger mechanism remain consistent: to allow the trigger body to move along a multidirectional path that conforms to the natural, arched motion of the human finger, as opposed to being constrained to a fixed, linear or single-plane path of travel. By enabling this natural actuation, the mechanism promotes improved ergonomics, reduced user fatigue, and enhanced precision—regardless of the specific host platform or firing system architecture into which it may be integrated.

In various embodiments, the geometry and configuration of the multidirectional trigger mechanism may be adapted to suit a wide range of firearms and host platforms. For example, the mechanism may be implemented in handguns, including revolvers and subcompact or compact pistols (e.g., micro-9 mm or concealment models), as well as in rifles, such as sniper or precision rifles (e.g., bolt-action or semi-automatic platforms like the Remington 700 or Accuracy International systems). Additional applicable host platforms may include pistol-caliber carbines (PCCs), which are compact rifles chambered in pistol ammunition (e.g., 9 mm or 0.45 ACP); personal defense weapons (PDWs), which are compact, select-fire arms often chambered in proprietary intermediate rounds; and submachine guns. The trigger mechanism may also be integrated into shotguns, including semi-automatic shotguns commonly used in tactical or defensive scenarios. This versatility allows the disclosed mechanism to accommodate a diverse array of firearms while preserving the core ergonomic and functional benefits described herein.

In some instances, the multidirectional trigger mechanism may be implemented in a variety of configurations tailored to different performance requirements, manufacturing constraints, or user preferences. For example, in addition to purely mechanical variants, the mechanism may be implemented as part of a hybrid or electronic system in which trigger movement may be detected by one or more sensors—such as Hall-effect sensors, strain gauges, piezoelectric elements, or optical encoders—and converted into an electrical signal that actuates a digital or electromechanical firing interface. These sensor-based implementations may be particularly useful in air-powered tools, training simulators, or future-generation smart firearms where traditional mechanical linkages are minimized or absent.

In some examples, the trigger mechanism may include user-adjustable components to allow fine-tuning of travel range, actuation force, return bias, or tactile feedback. These adjustments may be implemented via threaded limit screws, interchangeable resistance modules, adjustable preloads, or modular inserts that enable users to customize the trigger experience to match personal preference or mission-specific requirements. In certain cases, the trigger assembly may be designed as a removable cartridge or self-contained module, enabling drop-in replacement, factory upgrades, or compatibility with aftermarket systems.

In some examples, electronic variants of the trigger mechanism may further incorporate one or more intelligent safety systems. For instance, the system may include proximity sensors, capacitive touch sensors, or biometric readers configured to detect authorized users or confirm deliberate engagement before allowing actuation. In other cases, a sensor-based safety override may be used to temporarily inhibit trigger displacement unless predefined grip pressure or hand placement conditions are met. These advanced safety features may be particularly beneficial in high-risk or regulated environments and may be implemented alongside or independent of traditional mechanical safeties.

In various embodiments, the trigger mechanism may further include diagnostic, logging, or calibration features, particularly in platforms incorporating electronic sensing. For example, a system may be configured to record actuation force profiles, usage patterns, or trigger pull durations, which could be used for training feedback, maintenance prediction, or regulatory compliance. While not essential to the core functionality of the mechanism, these features illustrate the potential versatility of the system architecture and highlight how the disclosed trigger design may evolve alongside emerging technologies in human-machine interfaces.

In some scenarios, the multidirectional trigger mechanism disclosed herein may be particularly advantageous during dynamic, high-pressure, or ergonomically inconsistent use conditions. For example, a user—such as a law enforcement officer, military operator, or competitive shooter—may be required to engage the trigger under stress or from a non-standard grip posture. In such instances, the user's finger may approach the trigger from a lateral or oblique angle, or may rest deeper or shallower within the trigger guard than anticipated. Rather than forcing the finger into alignment with a fixed actuation path, the trigger body may instead pivot or articulate in conformance with the natural arched motion of the finger, enabled by the underlying multiaxial joint and compliant linkage.

As the user applies pressure, the trigger body may move along a trajectory that may be unique to the hand position and finger dynamics of that specific moment. Regardless of whether the path is rearward, upward-rearward, or angled laterally, the mechanism may accommodate the motion without introducing excess friction, binding, or directional resistance-thereby causing the user's aim of the firearm to be pulled or pushed off target. Once the displacement or actuation threshold is met, the linkage may reliably engage the firing interface, resulting in a consistent and predictable firing event. Because the actuation may not be restricted to a single path, plane, or direction, users may benefit from improved shot stability, reduced input variability, and enhanced confidence in trigger performance.

Following actuation, the return mechanism may restore the trigger body to its neutral position, allowing for rapid re-engagement or successive firing cycles without mechanical hesitation. This naturalistic and forgiving behavior may be especially beneficial in scenarios requiring reflexive firing, unconventional stances, or operation under reduced visibility or high fatigue conditions.

The subject-matter of the present disclosure will now be described more fully with reference to the accompanying drawings. However, it should be understood that the drawings are merely illustrative embodiments of the present disclosure, and the technologies disclosed herein may be embodied in many different forms and should not be construed as limited to the examples set forth herein. Additionally, the examples illustratively disclosed herein may be practiced in the absence of certain elements, regardless of whether or not those elements are specifically disclosed herein. That is, other arrangements and elements may be used in addition to or instead of those shown, and some elements may be omitted altogether.

FIG. 1 illustrates a side view of an example multidirectional trigger mechanism 100, in accordance with some embodiments of the present disclosure. As illustrated in FIG. 1, the multidirectional trigger mechanism 100 includes a trigger body 102 operatively connected to one or more multiaxial joints 104. The trigger body 102 is configured to articulate about a rotation point 106 defined in part by the multiaxial joint 104, which may serve as the center of angular displacement. The trigger body 102 is further coupled to a linkage 108, which transmits motion from the trigger to a firing interface 110 associated with a firing mechanism 112 of a host device, such as a firearm or manually actuated tool.

In the illustrated example, the multiaxial joints 104 are depicted as spherical joints, though other joint types may be used without departing from the scope of the present disclosure. These joints allow for multidirectional rotation or pivoting of the trigger body 102 within a constrained envelope of motion. Although FIG. 1 is shown in two dimensions for illustrative clarity, it should be understood that the trigger body 102 is not limited to movement in the x-y plane. Rather, in some embodiments, the trigger body 102 may also move along or about a third orthogonal axis-commonly referred to as the z-axis-thereby enabling true three-dimensional motion. For instance, the trigger body 102 may tilt forward or backward relative to the plane of the page, or may incorporate a twisting or oblique rotation that corresponds with the natural biomechanics of finger actuation.

The multiaxial joints 104 may be disposed at various locations on the trigger mechanism 100 depending on platform constraints or desired motion characteristics. In some examples, a primary joint may be positioned at or near the upper portion of the trigger body 102 to define the primary rotation point 106, while a secondary joint may be used to couple the linkage 108 in a compliant and directionally agnostic manner. This dual-joint arrangement allows the linkage 108 to respond predictably even when the trigger body 102 moves along compound, non-linear paths.

The linkage 108 may be operatively connected to the firing interface 110, which in turn actuates a firing mechanism 112 upon reaching a defined displacement or force threshold. In some instances, the firing interface 110 may include a mechanical sear, striker release, or other actuation system configured to respond consistently regardless of the motion vector taken by the trigger body 102. The design illustrated in FIG. 1 is intended to demonstrate the functional interplay between the trigger body 102, multiaxial joint(s) 104, and firing interface 110, and may be adapted or reconfigured to accommodate the geometry and firing architecture of a specific host device.

The x- and y-axes shown in FIG. 1 are provided for reference and may correspond to a coordinate frame associated with the host device. In some examples, the x-axis may represent a longitudinal axis of the host device—such as the barrel axis of a firearm—extending in a fore-aft direction relative to the user. The y-axis may represent a vertical axis orthogonal to the longitudinal axis, and the z-axis (not shown) may correspond to a lateral or depth axis that extends into and out of the page. Accordingly, movement of the trigger body 102 may occur along or about one or more of these axes, either individually or in combination, to produce a compound motion path that conforms to the natural arched trajectory of a human finger during trigger engagement, in contrast to conventional trigger mechanisms.

Figure 2A:
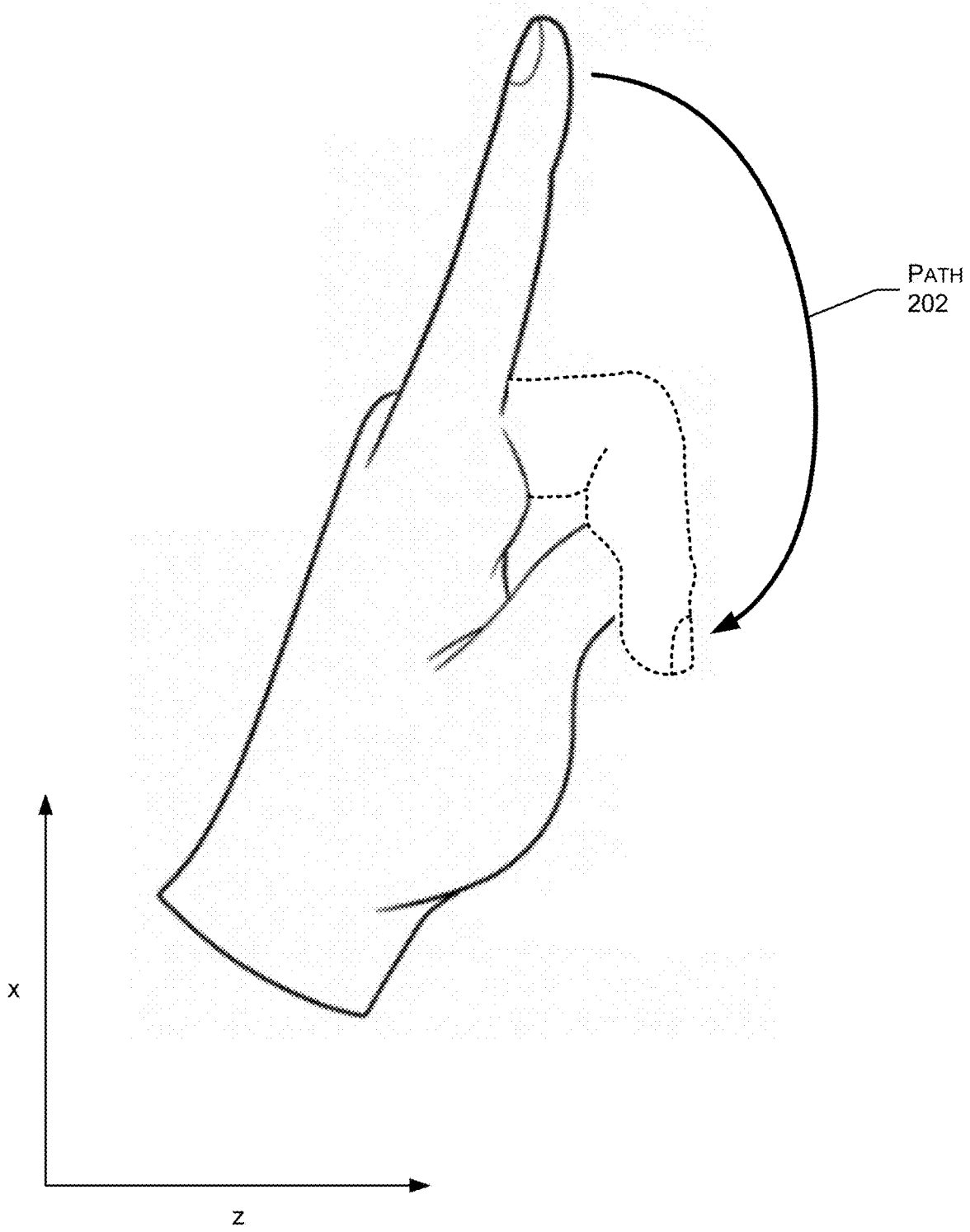
FIG. 2A illustrates an example of the natural motion path of a human index finger.
Figure 2B:
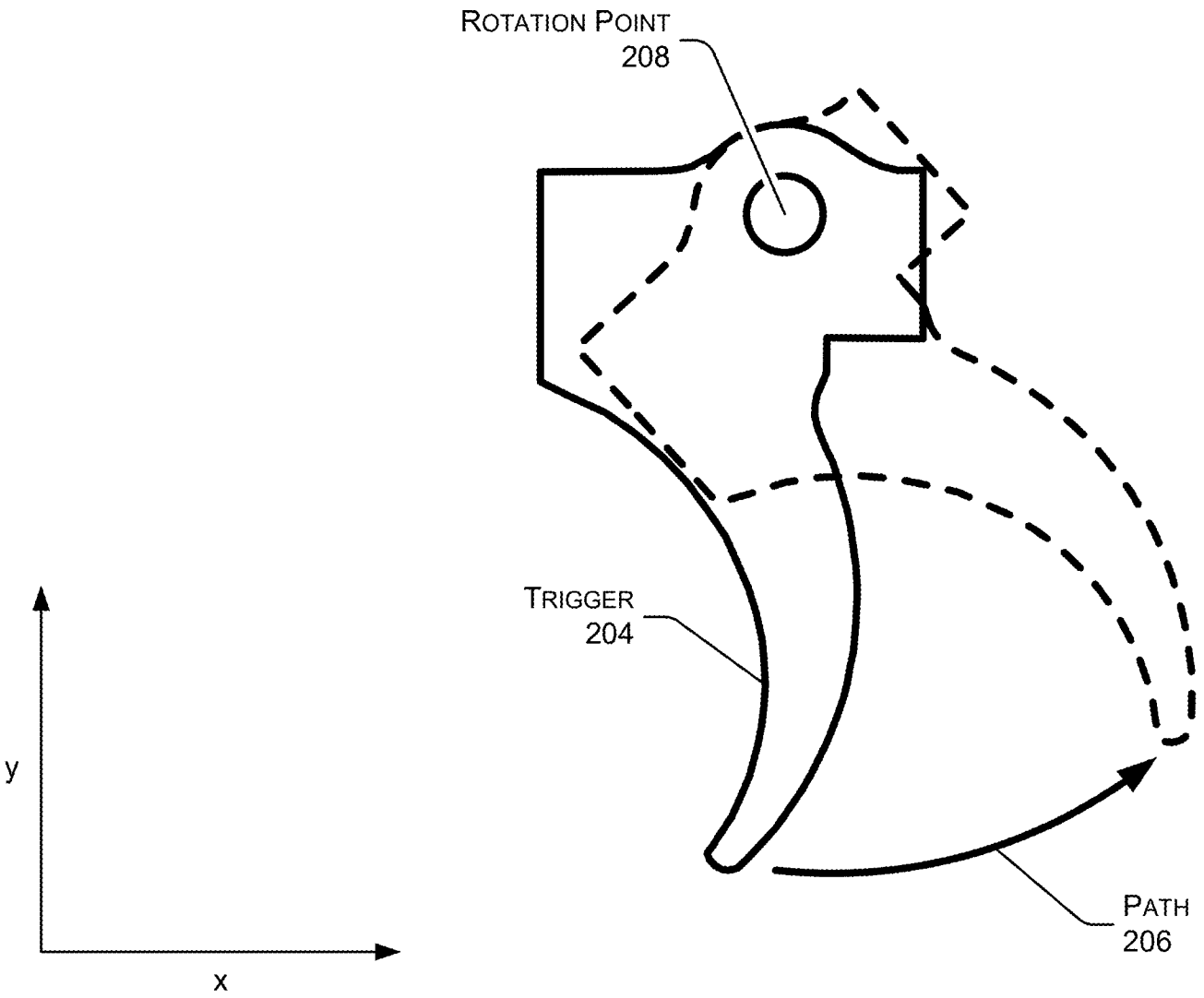
FIG. 2B illustrates an example of a conventional trigger having a fixed trigger path.

For example, FIG. 2A illustrates an example of the natural motion path 202 of a human index finger, while FIG. 2B illustrates an example of a conventional trigger 204 having a fixed trigger path 206. As shown in FIG. 2A, the natural motion path 202 of the human index finger during a trigger pull is not limited to a single planar trajectory. Instead, the fingertip tends to follow an arched or curved path as it flexes at the distal, intermediate, and proximal interphalangeal joints. In the illustrated coordinate system, the motion path 202 extends in both the x and z directions—where the x-axis may again represent the longitudinal axis of the host device (e.g., extending forward and rearward along the firearm), and the z-axis corresponds to a lateral or side-to-side axis across the user's hand. In this orientation, the y-axis—though not shown—extends orthogonally out of the page, corresponding to a vertical axis relative to the user or host device. This multidimensional arc reflects the natural kinematic behavior of the human finger, which rotates and contracts in a complex, elliptical pattern rather than a strictly linear pull. The curvature of path 202 further underscores the importance of designing trigger mechanisms that are capable of accommodating three-dimensional actuation vectors, rather than constraining motion to a fixed, one-dimensional plane.

By contrast, FIG. 2B illustrates a conventional trigger 204 configured to pivot about a fixed rotation point 208. The trigger 204 follows a predefined path 206, typically restricted to a forward-and-rearward arc within a single vertical plane-most commonly the x-y plane in a firearm context. This restricted motion path 206 may correspond to a partial circular arc defined by the trigger's rotation about rotation point 208. As indicated by the dashed outline, the trigger 204 pivots rearward when pulled, but lacks the capacity to move laterally, vertically, or obliquely beyond the constrained arc. As a result, any deviation in finger angle, entry depth, or off-axis force may lead to discomfort, unintended lateral loading, or diminished precision during use.

The comparison between FIGS. 2A and 2B highlights the ergonomic disparity between natural finger biomechanics and the motion constraints imposed by conventional trigger designs. Whereas FIG. 2A depicts a multidirectional, anatomically natural motion, FIG. 2B demonstrates the uniaxial constraint imposed by a fixed pivot trigger. This disconnect may lead to user fatigue, instability, or reduced control—particularly in situations requiring rapid, reflexive, or repeated trigger engagements. Notably, in the illustrated examples, the motion of the user's finger occurs primarily within the x-z plane, following a lateral and longitudinal arc consistent with human anatomy, whereas the actuation path of the conventional trigger shown in FIG. 2B is confined to the x-y plane, resulting in misalignment between user input and mechanical response. The multidirectional trigger mechanisms disclosed in the present application are intended to resolve this mismatch by allowing the trigger body to articulate along compound paths more closely aligned with the motion path 202 shown in FIG. 2A, thereby improving ergonomics, control, and consistency in a broad range of use scenarios.

Figure 3:
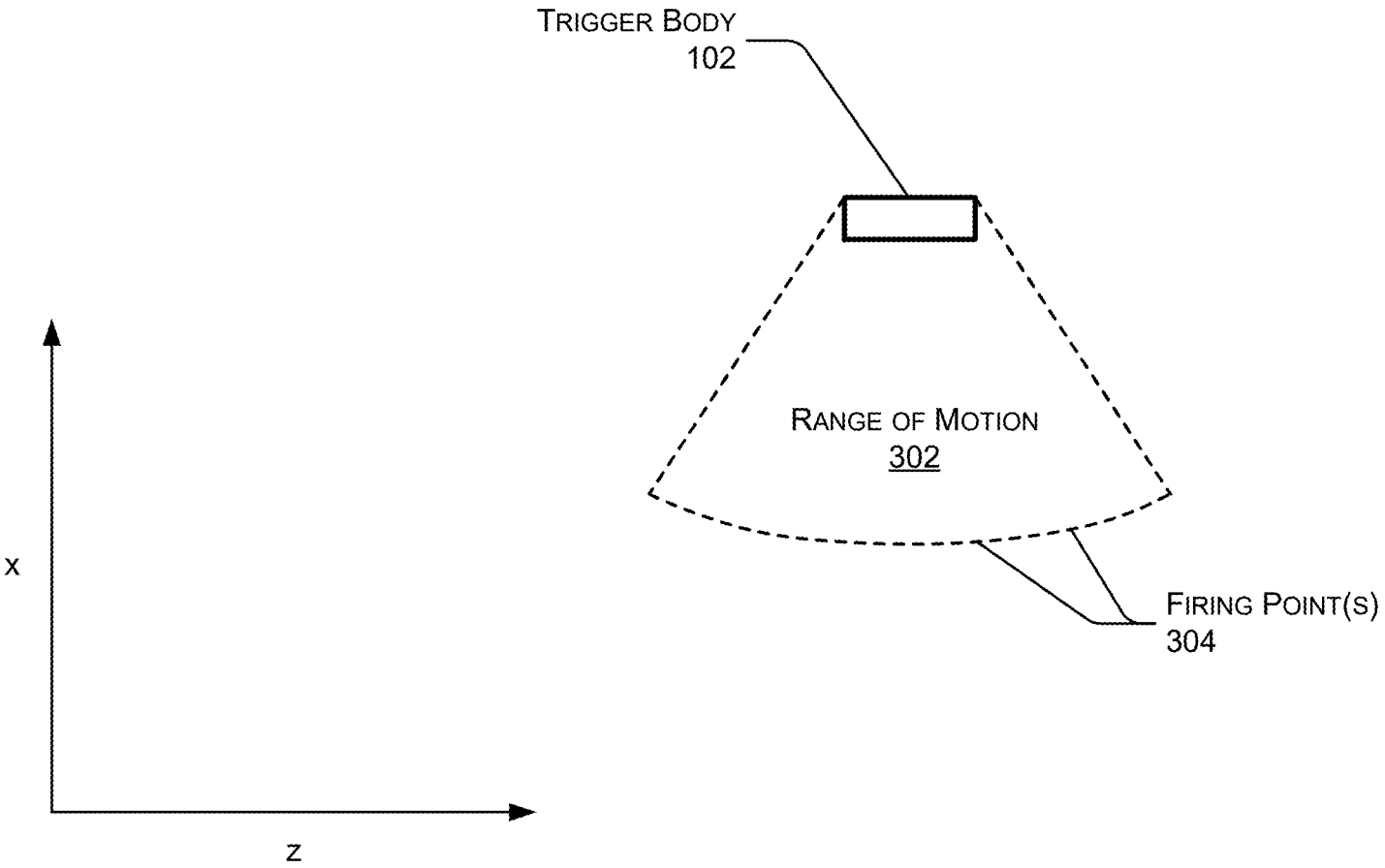
FIG. 3 is a top-down, cross-sectional view of a multidirectional trigger mechanism illustrating an exemplary range of motion associated with the trigger body, in accordance with some embodiments of the present disclosure.

Now referring to FIG. 3, FIG. 3 is a top-down, cross-sectional view of a multidirectional trigger mechanism illustrating an exemplary range of motion 302 associated with the trigger body 102, in accordance with some embodiments of the present disclosure. As shown, the trigger body 102 is positioned within a conical or fan-shaped range of motion 302 extending primarily in the x-z plane. This range of motion 302 represents the spatial envelope within which the trigger body 102 may articulate about one or more multi-axial joints (not shown in FIG. 3). In this top-down orientation, the x-axis may correspond to the longitudinal axis of the host device (e.g., the fore-aft direction of a firearm), while the z-axis extends laterally across the firearm. The y-axis—although not depicted in the figure—extends orthogonally out of the page and corresponds to a vertical or elevation axis relative to the host device. In some examples, and though not explicitly shown, the trigger body 102 may further move within or about the x-y plane (e.g., in a vertical arc or upward-rearward tilt), enabling compound articulation that reflects the three-dimensional motion path of a human finger. In contrast to conventional triggers constrained to a single actuation plane, the illustrated mechanism allows pivoting or rotation in longitudinal (x-axis), lateral (z-axis), and/or vertical (y-axis) directions. This multidirectional freedom allows the trigger body to conform more closely to the natural, arched trajectory discussed in connection with FIG. 2A, thereby reducing biomechanical mismatch and improving ergonomic engagement across diverse use scenarios.

Within the range of motion 302, one or more firing points 304 are defined. These firing points 304 may, in some examples, represent specific spatial positions or orientations of the trigger body 102 at which actuation of the firing interface may occur. In some examples, actuation may be triggered upon reaching a certain angular displacement, positional threshold, or cumulative force magnitude—regardless of the path taken to reach that point. Accordingly, the trigger mechanism may be responsive to inputs arriving from different angles or trajectories, allowing a wide range of user hand positions and finger motions to produce a reliable firing response. This flexibility not only enhances comfort and adaptability but may also improve operational consistency in high-stress or non-standard engagement scenarios.

The coordinate system shown in FIG. 3 includes the x-axis and z-axis, where the x-axis may represent the longitudinal axis of the host device, typically aligned with the barrel or firing direction, and the z-axis corresponds to a lateral or side-to-side axis. In this orientation, the y-axis (not shown) would extend vertically, orthogonal to the plane of the page. The x-z representation in FIG. 3 thus emphasizes the lateral and fore-aft freedom of movement afforded by the multidirectional trigger design. This top-down perspective complements the side-view illustration presented in FIG. 1, collectively demonstrating how the trigger body may articulate within a three-dimensional envelope rather than being confined to a single, predefined arc.

Figure 4A:
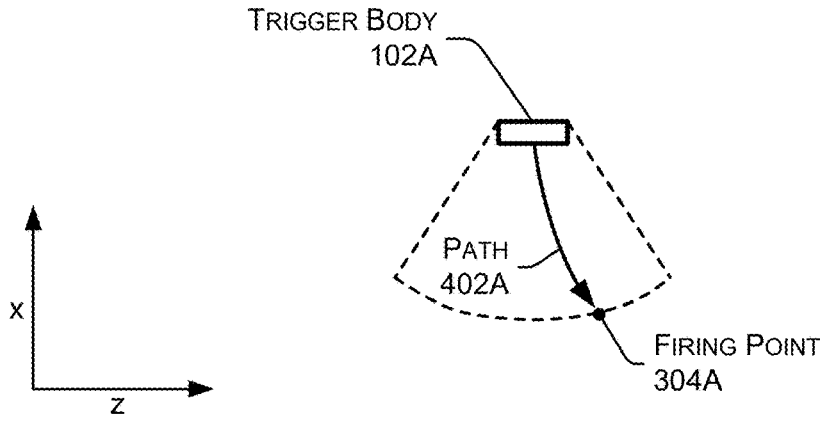
FIGS. 4A-4C illustrate various examples of trigger paths the multidirectional trigger mechanism may be capable of accommodating, in accordance with some embodiments of the present disclosure.
Figure 4B:
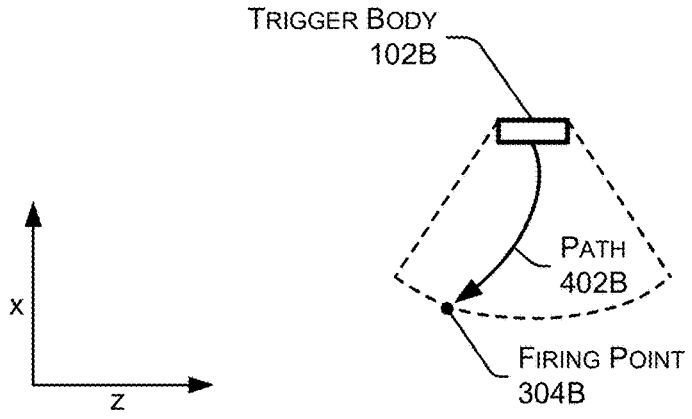
Figure 4C:
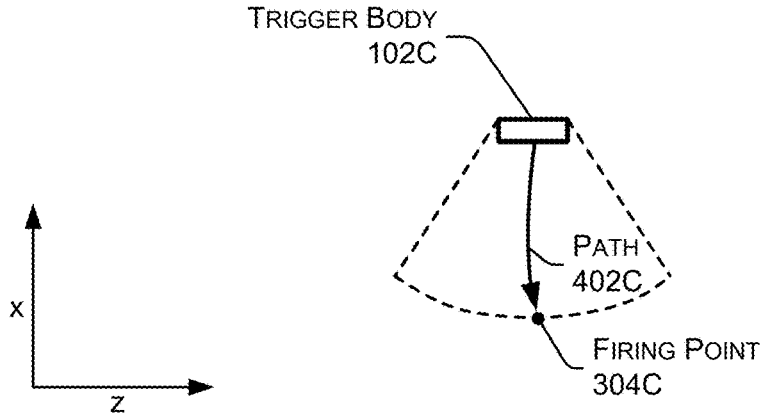

Now turning to FIGS. 4A-4C, these figures illustrate various examples of trigger paths the multidirectional trigger mechanism may be capable of accommodating, in accordance with some embodiments of the present disclosure. Each figure presents a top-down view similar to FIG. 3 and depicts a distinct motion trajectory 402A-402C traversed by a respective trigger body 102A-102C as it moves from a neutral position to an associated firing point 304A-304C. These motion paths demonstrate the ability of the trigger body to follow non-uniform or compound arcs within the x-z plane, reflecting the multidirectional capability of the underlying joint and linkage system.

In FIG. 4A, the trigger body 102A is shown moving along a primarily lateral and rearward path 402A, beginning from a neutral position and curving toward the firing point 304A located at the rear-right boundary of the motion envelope. This trajectory may be representative of a finger engaging the trigger from a slightly oblique angle or from a deeper-than-average position within the trigger guard.

FIG. 4B illustrates a similar configuration, with trigger body 102B moving along path 402B to reach firing point 304B. In this case, the path reflects a more balanced trajectory involving both lateral and longitudinal displacement.

Such a motion profile may occur when the user engages the trigger from a centered grip posture with moderate off-axis force, again demonstrating the system's ability to register and actuate based on a multidirectional approach. A left-handed user may also tend to have this motion path.

In FIG. 4C, the trigger body 102C follows a motion path 402C that is more centrally aligned along the x-axis, indicating a nearly straight rearward motion toward firing point 304C. While this path may resemble that of a conventional trigger, it remains unconstrained and is merely one of several possible trajectories supported by the system. Notably, the same trigger mechanism may register and respond to any of the illustrated paths (or others) so long as a defined actuation threshold is reached.

Across FIGS. 4A-4C, the coordinate axes again define the x-z plane, where the x-axis represents the longitudinal direction of the host device and the z-axis represents a lateral or side-to-side axis across the host device. Although the y-axis is not depicted in these figures, it extends orthogonally out of the page and may also be involved in real-world motion of the trigger body. In some examples, the trigger body may simultaneously displace within both the x-z and x-y planes, further supporting complex, user-dependent input paths. These illustrations highlight the system's ability to decouple firing actuation from a fixed path of travel, thereby accommodating a diverse range of engagement angles and grip dynamics without sacrificing consistency or reliability.

Figure 5:
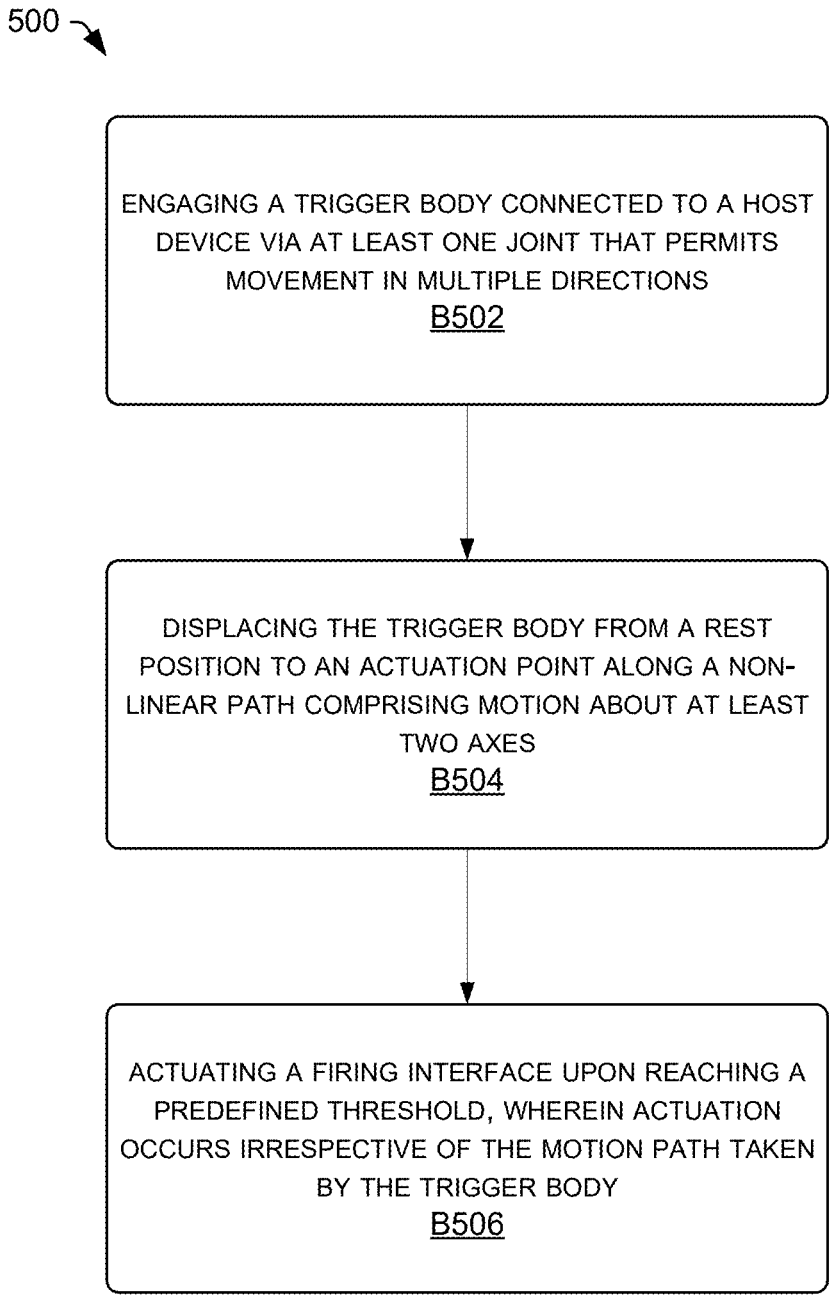
FIG. 5 is a flow diagram illustrating a method for using a multidirectional trigger mechanism to actuate a host device, in accordance with some embodiments of the present disclosure.

Now referring to FIG. 5, FIG. 5 is a flow diagram illustrating a method 500 for using a multidirectional trigger mechanism to actuate a host device, in accordance with some embodiments of the present disclosure. The method 500, at block B502, may include engaging a trigger body connected to a host device via at least one joint that permits movement in multiple directions. For instance, the trigger body 102, which may be connected to the host device via one or more multiaxial joints 104 permitting movement in multiple directions, may be engaged.

The method 500, at block B504, may include displacing the trigger body from a rest position to an actuation point along a non-linear path comprising motion about at least two axes. For example, the trigger body 102 may be displaced form a rest position to an actuation point (e.g., firing point(s) 304) along a non-linear path comprising motion about at least two axes or planes (e.g., non-linear, planar motion).

The method 500, at block B506, may include actuating a firing interface upon reaching a predefined threshold, wherein actuation occurs irrespective of the motion path taken by the trigger body. For instance, the firing interface 110 may be actuate upon the location, displacement, or force applied to the trigger body 102 reaching the predefined threshold.

Example Clauses

A. A trigger mechanism for a firearm, the trigger mechanism comprising: a trigger body; and a joint connected to the trigger body, the joint configured to permit non-linear movement of the trigger body with respect to an axis that is substantially horizontal and perpendicular to a longitudinal axis of the firearm.

B. The trigger mechanism of paragraph A, wherein the joint is further configured to permit movement of the trigger body about a second axis that is generally vertical and perpendicular to both the longitudinal axis of the firearm and the horizontally perpendicular axis.

C. The trigger mechanism of any one of paragraphs A-B, wherein the joint is a flexible mounting arrangement and the movement of the trigger body corresponds to at least one of pivoting or articulation of the trigger body within a constrained range of motion.

D. The trigger mechanism of any one of paragraphs A-C, wherein the joint comprises an articulated connection configured to allow compound movement of the trigger body in multiple directions.

E. The trigger mechanism of any one of paragraphs A-D, wherein the trigger body is configured to return to a rest position after actuation via a biasing component associated with the joint.

F. The trigger mechanism of any one of paragraphs A-E, further comprising a firing interface configured to actuate a firing mechanism associated with the firearm when the trigger body reaches a defined actuation point.

G. The trigger mechanism of any one of paragraphs A-F, wherein the firing interface is further configured to actuate the firing mechanism regardless of the motion path taken by the trigger body to reach the actuation point.

H. A trigger mechanism comprising: a trigger body; and a joint connected to the trigger body and configured to permit movement of the trigger body in multiple directions within a defined range of motion.

I. The trigger mechanism of paragraph H, wherein the movement of the trigger body in the multiple directions comprises rotational movement, within a defined range of motion, about a pivot point defined by the joint.

J. The trigger mechanism of any one of paragraphs H-I, wherein the pivot point is located at a center of the joint, and the rotational movement of the trigger body occurs about at least two perpendicular axes intersecting at the pivot point.

K. The trigger mechanism of any one of paragraphs H-J, wherein the rotational movement of the trigger body about each of the perpendicular axes is limited to a predefined angular range, such that a total displacement of the trigger body is constrained within a spatial boundary defined by the joint.

L. The trigger mechanism of any one of paragraphs H-K, wherein the joint comprises a double-pin linkage configured to allow rotational movement of the trigger body about a first axis and a second axis, the first axis being substantially horizontal and perpendicular to a longitudinal axis of a firearm, and the second axis being substantially vertical and perpendicular to the first axis.

M. The trigger mechanism of any one of paragraphs H-L, wherein the joint comprises a compound pivot joint comprising two substantially horizontal pivot axes arranged in separate planes, the pivot axes enabling sequential or compound rotation of the trigger body within a bounded range of motion.

N. The trigger mechanism of any one of paragraphs H-M, wherein the joint comprises at least one of: a spherical joint; a compound pivot joint; an articulated connection; a flexible mounting arrangement; a multi-axis linkage.

O. The trigger mechanism of any one of paragraphs H-N, further comprising: a firing interface; and a linkage, the linkage configured to transfer movement from the trigger body to the firing interface.

P. The trigger mechanism of any one of paragraphs H-O, wherein the trigger mechanism is configured to actuate a firing mechanism associated with a firearm based at least on at least one of: a displacement of the trigger body in an aft direction meeting or exceeding a threshold displacement; or a pressure applied to the trigger body meeting or exceeding a threshold pressure, wherein the actuation occurs regardless of a travel path taken by the trigger body.

Q. A firearm comprising: a firing mechanism; and a trigger mechanism, the trigger mechanism comprising: a trigger body; and a linkage operatively coupling the trigger body to the firing mechanism to transfer movement from the trigger body to the firing mechanism, wherein the trigger body is connected to the linkage via one or more joints that permit the trigger body to move in multiple directions within a defined range of motion.

R. The firearm of paragraph Q, wherein the firearm is at least one of: a handgun; a revolver; a subcompact or compact pistol; a rifle; a sniper or precision rifle; a pistol-caliber carbine (PCC); a shotgun; a semi-automatic shotgun; a carbine; a personal defense weapon (PDW); or a submachine gun.

S. The firearm of any one of paragraphs Q-R, wherein the movement of the trigger body in the multiple directions comprises rotational movement, within the defined range of motion, about a pivot point located at a center of the one or more joints, and the rotational movement of the trigger body occurs about at least two perpendicular axes intersecting at the pivot point.

T. The firearm of any one of paragraphs Q-S, wherein the one or more joints include a compound pivot joint comprising two substantially horizontal pivot axes arranged in separate planes, the pivot axes enabling sequential or compound rotation of the trigger body.

U. A method of actuating a firing mechanism using a multidirectional trigger mechanism, the method comprising: engaging a trigger body connected to a host device via at least one joint that permits movement in multiple directions; displacing the trigger body from a rest position to an actuation point along a non-linear path comprising motion about at least two axes; and actuating a firing interface upon reaching a predefined threshold, wherein actuation occurs irrespective of the motion path taken by the trigger body.

V. The method of paragraph U, wherein the actuation point corresponds to a threshold displacement, angular orientation, or applied pressure on the trigger body.

W. The method of any one of paragraphs U-V, further comprising: returning the trigger body to the rest position via a return mechanism comprising at least one spring, biasing element, or elastomeric component.

X. The method of any one of paragraphs U-W, wherein the motion path of the trigger body includes movement within both a first plane defined by a longitudinal and lateral axis, and a second plane defined by a longitudinal and vertical axis.

Y. The method of any one of paragraphs U-X, wherein actuating the firing interface comprises transmitting movement of the trigger body through a linkage to the firing interface.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

What is claimed is:

1. A trigger mechanism for a firearm, the trigger mechanism comprising:

a trigger body; and a joint connected to the trigger body, the joint configured to permit non-linear movement of the trigger body with respect to an axis that is substantially horizontal and perpendicular to a longitudinal axis of the firearm, wherein the joint is a compound pivot joint comprising two substantially horizontal pivot axes arranged in separate planes, the pivot axes enabling sequential or compound rotation of the trigger body within a bounded range of motion.

2. The trigger mechanism of claim 1, wherein the joint is further configured to permit movement of the trigger body about a second axis that is generally vertical and perpendicular to both the longitudinal axis of the firearm and the horizontally perpendicular axis.

3. The trigger mechanism of claim 1, wherein the joint is a flexible mounting arrangement and the movement of the trigger body corresponds to at least one of pivoting or articulation of the trigger body within a constrained range of motion.

4. The trigger mechanism of claim 1, wherein the joint comprises an articulated connection configured to allow compound movement of the trigger body in multiple directions.

5. The trigger mechanism of claim 1, wherein the trigger body is configured to return to a rest position after actuation via a biasing element associated with the joint.

6. The trigger mechanism of claim 1, further comprising a firing interface configured to actuate a firing mechanism associated with the firearm when the trigger body reaches an actuation point.

7. The trigger mechanism of claim 6, wherein the firing interface is further configured to actuate the firing mechanism regardless of a motion path taken by the trigger body to reach the actuation point.

8. A trigger mechanism comprising:

a trigger body; and a joint connected to the trigger body and configured to permit movement of the trigger body along a non-linear path relative to a substantially horizontal axis that is perpendicular to an intended longitudinal axis of a host device, wherein the trigger body is configured to return to a rest position after actuation via a biasing element associated with the joint.

9. The trigger mechanism of claim 8, wherein the joint comprises a double-pin linkage configured to allow rotational movement of the trigger body about a first axis and a second axis, the first axis being substantially horizontal and perpendicular to a longitudinal axis of a firearm, and the second axis being substantially vertical and perpendicular to the first axis.

10. The trigger mechanism of claim 8, wherein the joint comprises a compound pivot joint comprising two substantially horizontal pivot axes arranged in separate planes, the pivot axes enabling sequential or compound rotation of the trigger body within a bounded range of motion.

11. The trigger mechanism of claim 8, wherein the joint comprises at least one of:

a spherical joint;

a compound pivot joint;

an articulated connection;

a flexible mounting arrangement; or a multi-axis linkage.

12. The trigger mechanism of claim 8, further comprising:

a firing interface; and a linkage, the linkage configured to transfer movement from the trigger body to the firing interface.

13. The trigger mechanism of claim 8, wherein the trigger mechanism is configured to actuate a firing mechanism associated with a firearm based at least on at least one of:

a displacement of the trigger body in an aft direction meeting or exceeding a threshold displacement; or a pressure applied to the trigger body meeting or exceeding a threshold pressure, wherein the actuation occurs regardless of a travel path taken by the trigger body.

14. A firearm comprising:

a firing mechanism; and a trigger mechanism, the trigger mechanism comprising:

a trigger body; and a linkage operatively coupling the trigger body to the firing mechanism to transfer movement from the trigger body to the firing mechanism, wherein the trigger body is connected to the linkage via one or more joints that permit the trigger body to move along a non-linear path relative to a substantially horizontal axis that is perpendicular to a longitudinal axis of the firearm, the trigger body configured to return to a rest position after actuation via a biasing element associated with the joint.

15. The firearm of claim 14, wherein the firearm is at least one of:

a handgun;

a revolver;

a subcompact or compact pistol;

a rifle;

a sniper or precision rifle;

a pistol-caliber carbine (PCC);

a shotgun;

a semi-automatic shotgun;

a carbine;

a personal defense weapon (PDW); or a submachine gun.

16. The firearm of claim 14, wherein the one or more joints include a compound pivot joint comprising two substantially horizontal pivot axes arranged in separate planes, the pivot axes enabling sequential or compound rotation of the trigger body.

17. The firearm of claim 14, wherein force applied to the trigger body in a direction having a lateral component relative to the longitudinal axis of the firearm is translated by the one or more joints into movement of the linkage sufficient to actuate the firing mechanism.

18. The trigger mechanism of claim 8, wherein the host device is a firearm and the intended longitudinal axis corresponds to a bore axis of the firearm.

19. The trigger mechanism of claim 8, wherein the non-linear path comprises a curved translational component defined by at least one of a cam surface, a cam follower, or a slot configured to guide movement of the trigger body.

20. The trigger mechanism of claim 12, wherein the joint is configured to permit angular misalignment between the trigger body and the linkage while maintaining operative coupling to actuate a firing mechanism coupled to the linkage.

* * * * *